US005604994A

United States Patent [19]

Annen et al.

[11] Patent Number: 5,604,994

[45] Date of Patent: Feb. 25, 1997

[54] DRYING HOPPER AND POWDER DRYING METHOD USING THE SAME

[75] Inventors: Yoshiaki Annen, Ichihara; Akira Tsuzaki, Tokyo; Isao Shizuma, Tokyo; Takao Uetake, Tokyo; Mitsunori Ichimura, Ichihara, all of Japan

[73] Assignee: Mitsui Petrochemical Industries, Ltd., Tokyo, Japan

[21] Appl. No.: 392,200

[22] Filed: Feb. 22, 1995

Related U.S. Application Data

[62] Division of Ser. No. 61,367, May 14, 1993, Pat. No. 5,423, 133.

[30] Foreign Application Priority Data

May 15, 1992 [JP] Japan ..... 4-123671

[51] Int. Cl.[6] ..... F26B 5/08

[52] U.S. Cl. ..... 34/314; 34/327; 34/487; 34/498; 34/507

[58] Field of Search ..... 34/58, 168, 314, 34/327, 448, 487, 493, 498, 507

[56] References Cited

U.S. PATENT DOCUMENTS

| | | | |
|---|---|---|---|
| 2,353,346 | 11/1944 | Logan | 222/1 |
| 2,397,350 | 3/1946 | Hayden et al. | 34/170 |
| 3,112,188 | 11/1963 | Zehnder | 34/77 |
| 3,266,165 | 8/1966 | Apostle et al. | 34/168 |
| 3,279,094 | 10/1966 | Blanton | 34/233 |
| 3,328,131 | 6/1967 | Latham | 34/168 |
| 3,629,951 | 12/1971 | Davis et al. | 34/498 |
| 4,092,784 | 6/1978 | Dietrich et al. | 34/13 |
| 4,439,993 | 4/1984 | Dietrich et al. | 34/65 |
| 5,052,123 | 10/1991 | Tischendorf et al. | 34/168 X |

FOREIGN PATENT DOCUMENTS

| | | |
|---|---|---|
| 2317071 | 4/1977 | France . |
| 2632795 | 10/1977 | Germany . |
| WO8302995 | 1/1983 | WIPO . |

*Primary Examiner*—John M. Sollecito
*Assistant Examiner*—Steve Gravini
*Attorney, Agent, or Firm*—Sherman and Shalloway

[57] ABSTRACT

Disclosed is a drying hopper comprising, disposed in its lower position, a cone portion having diameters gradually decreasing toward a lower end thereof, in which a high temperature gas is injected toward powder descending in the cone portion to thereby dry the powder, wherein said drying hopper comprises a cone portion 11 having a slant, circular wall, said cone portion 11 having a plurality of vertically spaced rows of nozzles 20, formed through the circular wall, disposed at predetermined intervals in a circumferential direction of the circular wall; a plurality of vertically spaced ring-like shells 21 fluidtightly attached to an external surface of the circular wall of the cone portion 11 with interstices therebetween in positions such that said plurality of rows of nozzles 20 are respectively, at gas inlets thereof, covered by said plurality of ring-like shells 21; and a plurality of gas feed pipes 22 respectively connected to said plurality of ring-like shells 21 in communicating relationship. By virtue of this drying hopper, powder, e.g., polyethylene powder, can be dried to a solvent content as small as 20 ppm by weight or less by low cost, simple operations.

9 Claims, 8 Drawing Sheets

DRYING HOPPER AND POWDER DRYING METHOD USING THE SAME

This is a division of application Ser. No. 08/061,367 filed May 14, 1993, U.S. Pat. No. 5,423,133, issued Jun. 13, 1995.

FIELD OF THE INVENTION

This invention relates to a drying hopper most suitable for drying of various types of powders, such as those of polyolefins and various copolymers produced by a slurry polymerization technique, food, e.g., flour and cement, and a method for drying such powders using the drying hopper.

BACKGROUND OF THE INVENTION

Powders of polyethylene, polypropylene, polybutene and various copolymers are likely to contain solvents during the manufacturing process thereof, so that drying of such powders is generally required to reduce the solvent content thereof.

For example, a slurry polymerization process is known as a method for manufacturing polyethylene which finds wide applications in insulating materials, various containers, pipes, packings, lining materials for industrial apparatus, coating and packaging films and industrial fibers. In this slurry polymerization process, first, ethylene is polymerized in a reactor in the presence of a composite catalyst comprising an alkylaluminum and titanium tetrachloride etc. using a solvent, such as hexane, to obtain a slurry containing a solid polyethylene. Subsequently, the slurry is subjected to a solid liquid separation using a filter to obtain a wet cake of polyethylene powder. Thereafter, the wet cake is dried to obtain a dry polyethylene powder.

The obtained polyethylene powder generally contains the solvent, such as hexane, employed in the slurry polymerization, so that drying of the polyethylene powder is required to reduce the solvent content thereof.

The following two methods are known in the art for effecting the drying of the polyethylene powder. In one method, a rotary drying is employed. In particular, the polyethylene powder is dried while being transferred through a rotating cylinder of the rotary dryer. In the other method, use is made of a flash drying apparatus in combination with a fluidized drying apparatus. In particular, first, the polyethylene powder is floated into a high temperature air stream and dried while being transferred by the high temperature air stream (i.e., flash drying). Then, the polyethylene powder having been dried by the flash drying is placed on a porous plate in a fluidized drying apparatus, and hot air is fed from under the porous plate to fluidize and disperse the polyethylene powder so that the polyethylene powder is dried (i.e., fluidized drying).

In the first method, it has advantages in that the operating cost of the rotary dryer is relatively low and the operation thereof is relatively simple. However, the drying of the polyethylene powder by the use of the rotary dryer alone is only effective to reduce the solvent (hexane) content of the polyethylene powder to about 2000 ppm by weight. Since the solvent, such as hexane, contained in the polyethylene powder adversely affects he quality of the polyethylene, it is desired that the solvent content of the polyethylene powder be further reduced. For example, if the solvent content of the polyethylene powder is large, problems are likely to occur with respect to the odor and color of the final product obtained from the polyethylene powder. Further, in the use as a container for food, the elution of the solvent into the food may cause hygienic problems.

On the other hand, in the above-mentioned second drying method, it has disadvantages in that the operating cost of the flash drying apparatus and the fluidized drying apparatus is high and the operation thereof is considerably complicated, although the hexane content of the polyethylene powder can be reduced to about several tens of ppm by weight.

Therefore, any of the conventional drying methods is not satisfactory.

SUMMARY OF THE INVENTION

With a view toward developing a desirable powder drying apparatus and method, the present inventors have conducted extensive and intensive studies. As a result, they have unexpectedly found that this goal can be attained by a drying hopper having a cone portion with a specific structure. Based on this novel finding, the present invention has been completed.

It is, therefore, an object of the present invention to provide a drying hopper by which powder, such as polyethylene powder, can be dried to a solvent content of 20 ppm by weight or less with low operating costs and with simple operations.

It is another object of the present invention to provide a method for efficiently drying powder, such as polyethylene powder, using the above drying hopper.

The foregoing and other objects, features and advantages of the present invention will become apparent from the following detailed description and appended claims taken in connection with the accompanying drawings.

DETAILED DESCRIPTION OF THE INVENTION

Figure 1:
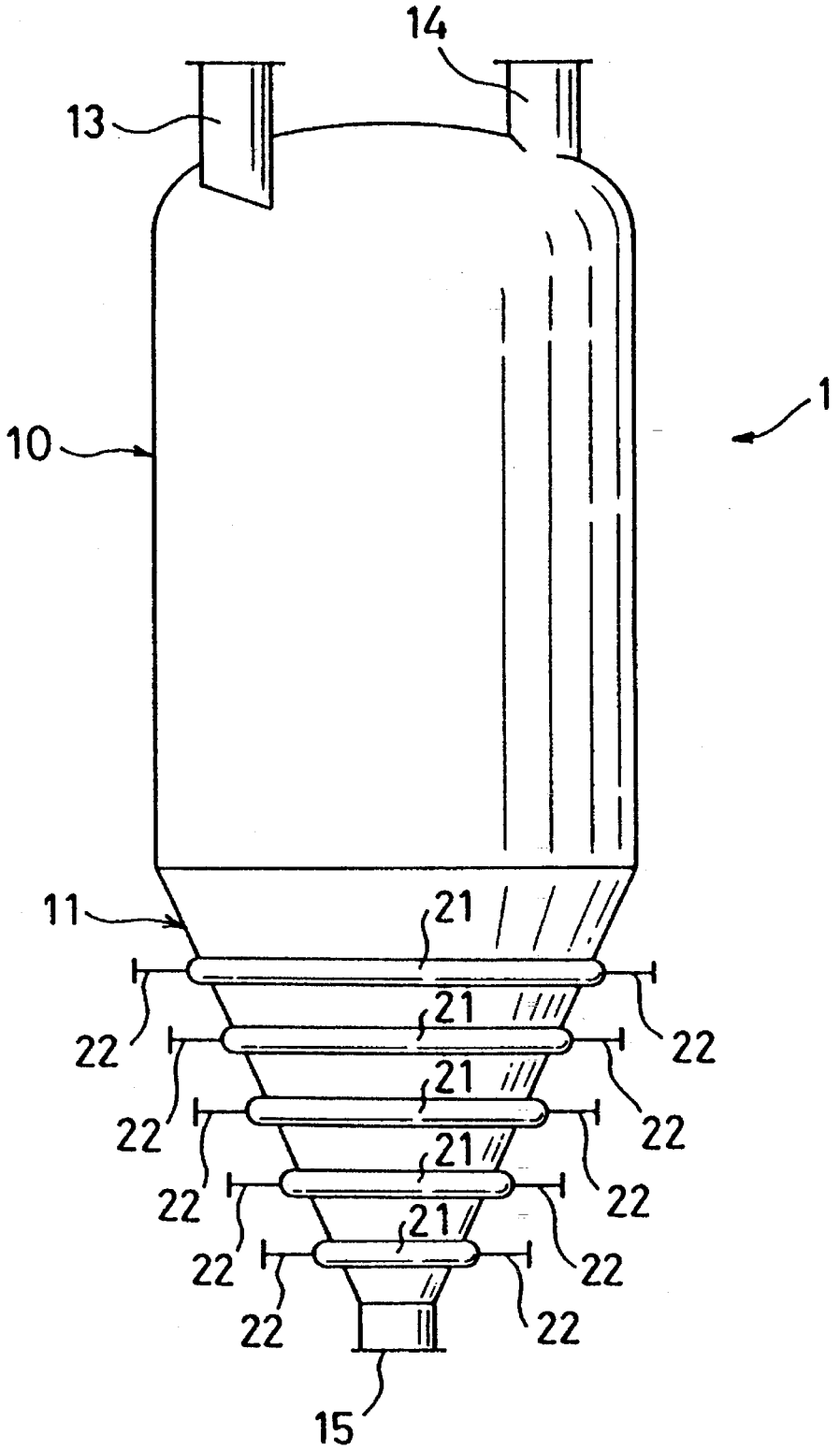
FIG. 1 is a schematic side view of a drying hopper according to one embodiment of the present invention.
Figure 2:
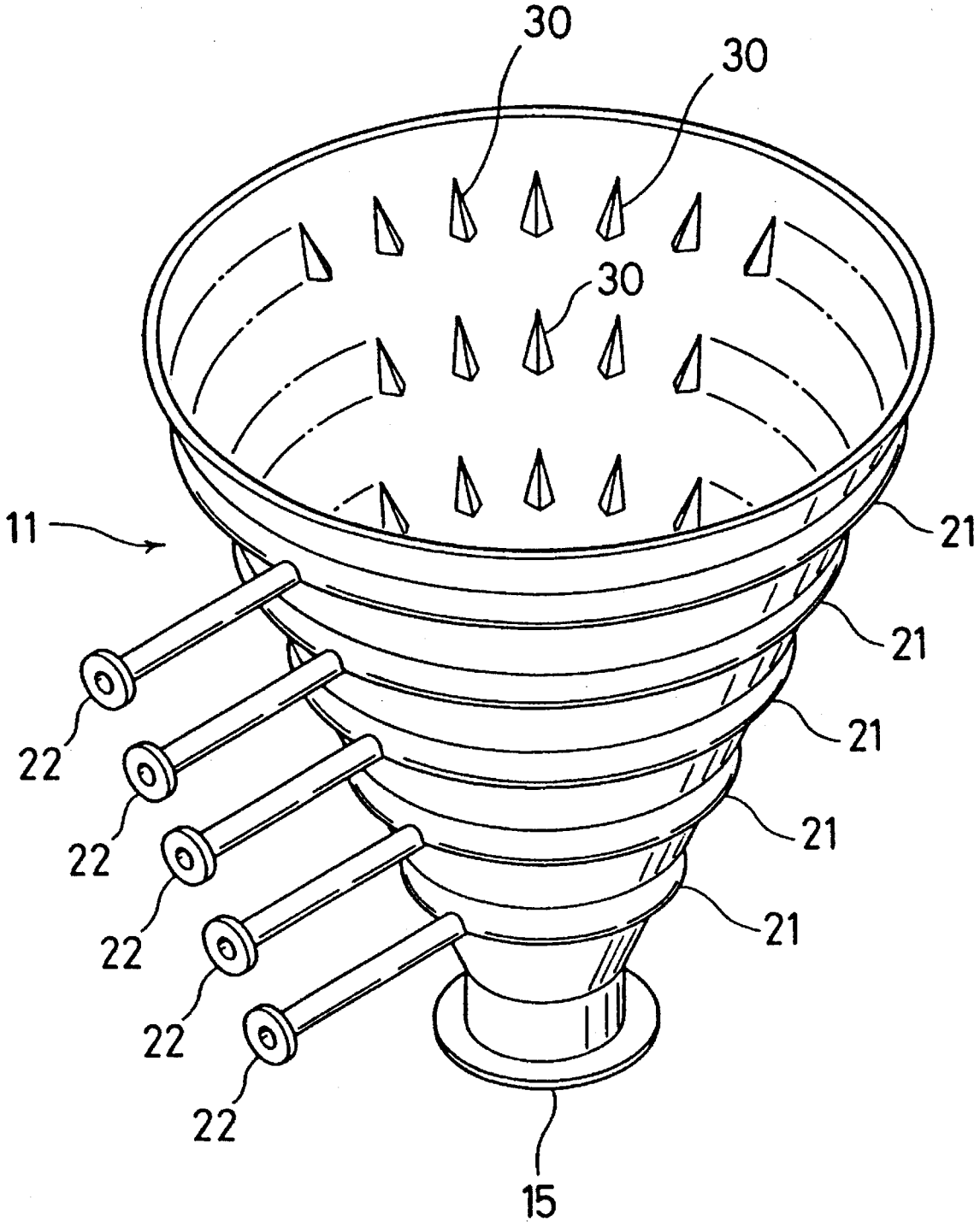
FIG. 2 is a perspective view of a cone portion of the drying hopper shown in FIG. 1.
Figure 3:
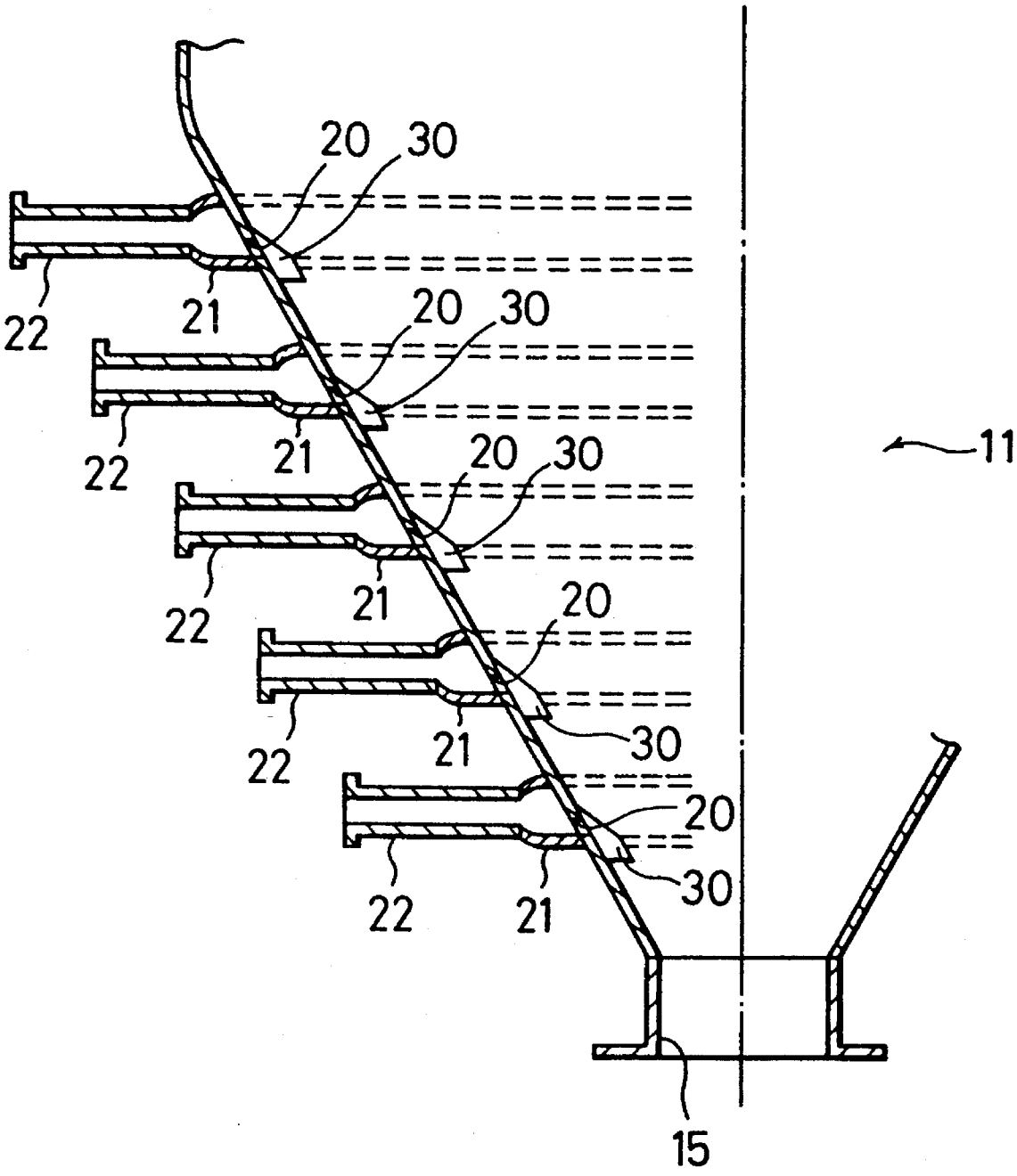
FIG. 3 is a vertical section view of the cone portion of the drying hopper shown in FIG. 2.
Figure 4:
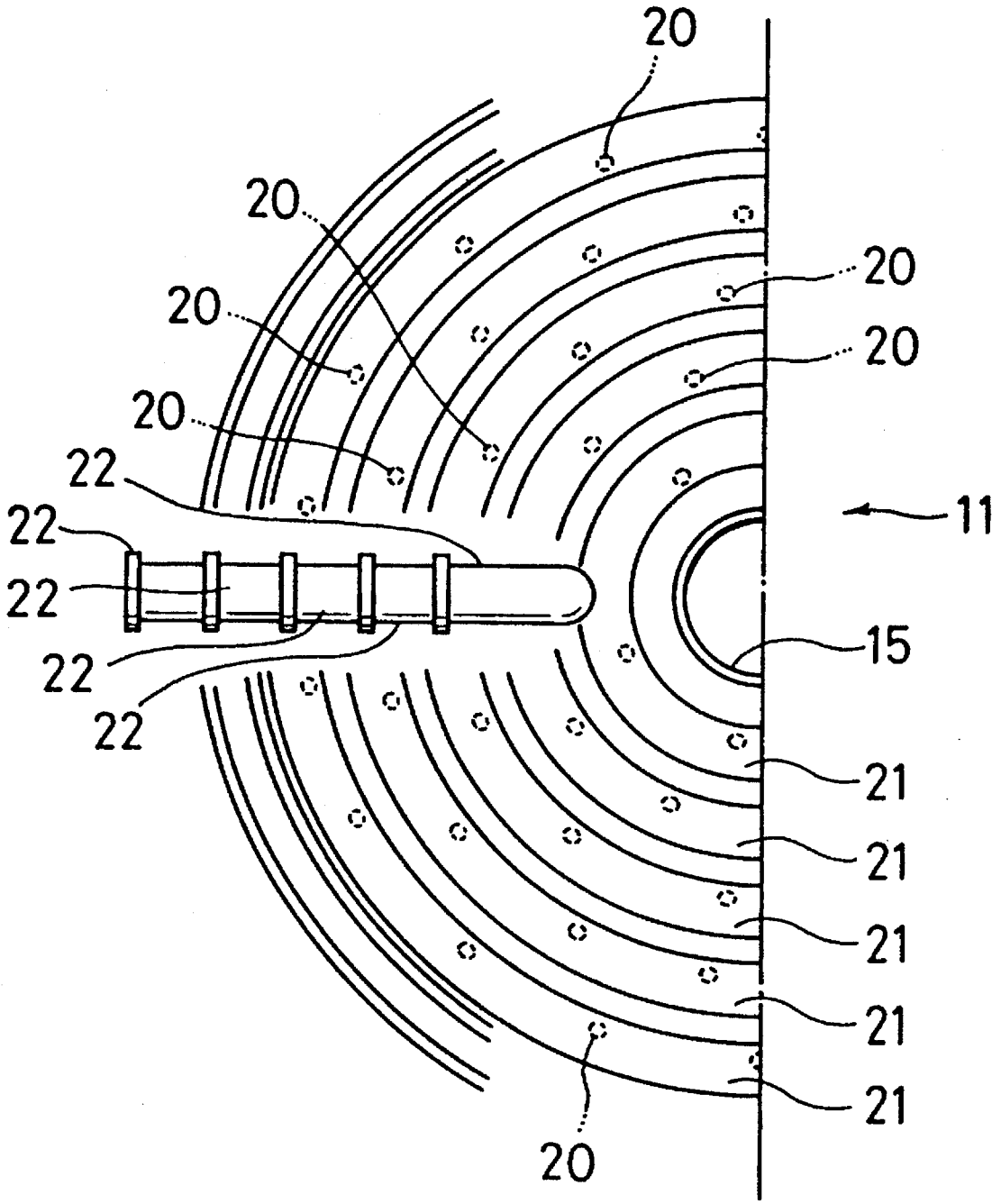
FIG. 4 is a bottom view of the cone portion of the drying hopper shown in FIG. 2.

In one and primary aspect of present invention, there is provided a drying hopper comprising, disposed in its lower position, a cone portion having diameters gradually decreasing toward a lower end thereof, in which a high temperature gas is injected toward powder descending in the cone portion to thereby dry the powder, wherein the drying hopper comprises:

a cone portion having a slant, circular wall, the cone portion having a plurality of vertically spaced rows of nozzles, formed through the circular wall, disposed at predetermined intervals in a circumferential direction of the circular wall, a plurality of vertically spaced ring-like shells fluidtightly attached to an external surface of the circular wall of the cone portion with interstices therebetween in positions such that the plurality of rows of nozzles are respectively, at gas inlets thereof, covered by the plurality of ring-like shells, and a plurality of gas feed pipes respectively connected to the plurality of ring-like shells in communicating relationship so that a high temperature gas is fed from the gas feed pipes to the respective ring-like shells and then through the respective rows of nozzles into the inside of the cone portion.

In the present invention, it is preferred that the drying hopper comprises a plurality of covering members, attached to an internal surface of the circular wall of the cone portion, respectively covering the nozzles at gas outlets thereof with an interstice between the covering member and the internal surface of the circular wall, the interstice being open at a lower end thereof.

In the drying hopper according to the present invention, it is preferred that the above-mentioned interstice present between the covering member and the internal surface of the circular wall of the cone portion have a cross section gradually expanding toward the lower end thereof.

Further, in the drying hopper according to the present invention, it is preferred that the gas inlets of the nozzles be open at respective lower zones of the interstices present between the ring-like shells and the external surface of the circular wall of the cone portion, and the gas outlets of the nozzles be positioned above respective lower ends of the covering members.

In another aspect of the present invention, there is provided a method for drying powder, comprising feeding powder to be dried (such as polyolefin powder obtained by a solid liquid separation of a polyolefin slurry produced by a slurry polymerization) into a drying hopper having, disposed in its lower position, a cone portion having a slant, circular wall having diameters gradually decreasing toward a lower end thereof, said cone portion having a plurality of nozzles formed through the circular wall, said feeding being conducted from an upper end of the drying hopper, while injecting a high temperature gas (such as nitrogen gas heated at °–110° C.) through said nozzles into the drying hopper so as to bring the high temperature gas into counterflow contact with said powder descending in the cone portion, thereby drying the powder.

The above-mentioned polyolefin is not particularly limited, and any polyolefin selected from an ethylene homopolymer, a linear low density polyethylene and polypropylene may be employed. Preferably, the polyolefin powder is dried to for example, a solvent content of 20 ppm by weight or less by the drying hopper in which the polyolefin powder is retained for a period of from 30 to 60 minutes, and in which a heated nitrogen gas is injected at a rate of from 20 to 60 $Nm^3$/ton-polyolefin.

In the structure of the drying hopper according to the present invention, the high temperature gas from the gas feed pipe is fed into the interstice through the ring-like shells (rings of cross-sectionally halved pipe), and then injected through the nozzles into the inside of the cone portion. Further, since the nozzles are uniformly arranged substantially throughout the cone portion, the high temperature gas is uniformly brought into contact with the powder fed from an upper portion of the drying hopper and descending therein to thereby markedly improve fluidization efficiency. Moreover, by virtue of the covering member provided on the internal surface of the circular wall of the cone portion, the entry of the powder descending in the cone portion into the nozzles can be prevented with certainty.

According to the present invention, the powder, such as the polyolefin powder obtained by a solid liquid separation of a polyolefin slurry produced by a slurry polymerization, is effectively dried to an extremely reduced solvent content by simple operations such that the high temperature gas is injected through the nozzles provided over the cone portion into the inside of the drying hopper while the powder to be dried is fed from an upper portion of the drying hopper into the inside thereof.

PREFERRED EMBODIMENT OF THE INVENTION

Preferred embodiment of the present invention will now be described in greater detail with reference to the accompanying drawings.

FIG. 1 schematically shows a drying hopper 1. The drying hopper 1 comprises a cylindrical portion 10 having a cylinder form, and a cone portion 11, arranged beneath the cylindrical portion 10, having a cone form having diameters gradually decreasing toward a lower end thereof.

In upper portions of the cylindrical portion 10, two powder inlets 13, 14 are provided for introducing powder to be dried. Further, at a lower end of the cone portion 11, powder outlet 15 is provided for discharging dried powder. The slant, circular wall of the cone portion 11 is provided with a high temperature gas feed system as described below.

Due to this structure, powder to be dried which has been introduced through the powder inlets 13, 14 gradually descends in the cylindrical portion 10 and the cone portion 11. While descending, the powder is brought into counterflow contact with the high temperature gas fed by the high temperature gas feed system into the inside of the drying hopper 1. Thus, the powder is dried, and the dried powder is discharged outside through the powder outlet 15.

It is preferred that the slant, circular wall of the cone portion 11 slant at an angle of about 20° against the vertical, from the viewpoint of the descending speed of the powder and the prevention of powder crosslinking etc. This is, however, not critical and does not limit the scope of the present invention.

The above-mentioned high temperature gas feed system feeds a high temperature gas, such as heated nitrogen gas, into the drying hopper 1, and has a structure as shown in FIGS. 1 through 8.

In the high temperature gas feed system, a plurality of nozzles 20 are formed through the slant, circular wall of the cone portion 11. Those nozzles 20 are not only disposed preferably at predetermined pitches, i.e., substantially equal intervals in a circumferential direction of the circular wall of the cone portion 11, but also disposed vertically in a plurality of rows (five rows in the FIGS.). Thus, the nozzles 20 are uniformly arranged substantially throughout the circular wall of the cone portion 11.

In a drying hopper having a volume of, for example, 67 $m^3$, it is generally preferred that at least 100 nozzles 20 be provided over the circular wall of the cone portion 11.

For obtaining desirable fluid conditions with respect to the powder to be dried the drying hopper has at least one nozzle 20, preferably at least 1.5 nozzles, per $m^3$. However, too many nozzles are not preferred for economic reasons. It is preferred that the nozzles 20 be disposed at equal intervals in a circumferential direction of the circular wall in each row.

Attached fluid tightly to the external surface of the circular wall of the cone portion 11 are a plurality of vertically spaced ring-like shells (rings of cross-sectionally halve pipes) 21 with interstices therebetween in positions such that a plurality of rows of nozzles 20 are respectively, at gas inlets thereof, covered by the plurality of ring-like shells 21. The ring-like shell 21 is for example, one obtained by splitting a cylindrical pipe into two pipes having a semicircular cross section and forming the resultant pipe into a ring. The function of the ring-like shell 21 is to temporarily stock the high temperature gas (heated nitrogen gas) fed from the below described gas feed pipe 22 and to inject the high temperature gas at a uniform pressure through the individual nozzles 20 of each row into the inside of the drying hopper.

Figure 5:
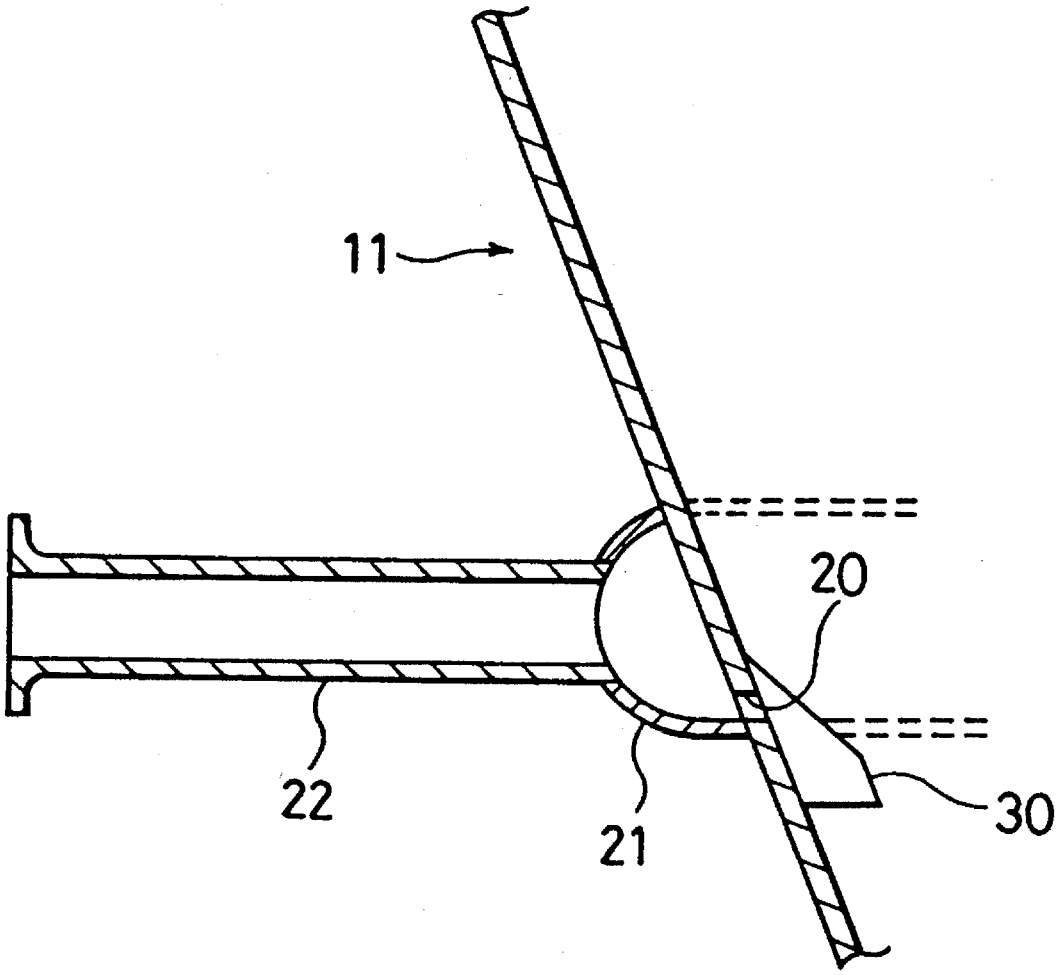
FIG. 5 is an enlarged section view showing the arrangement around a nozzle disposed in a cone portion according to the present invention.
Figure 9:
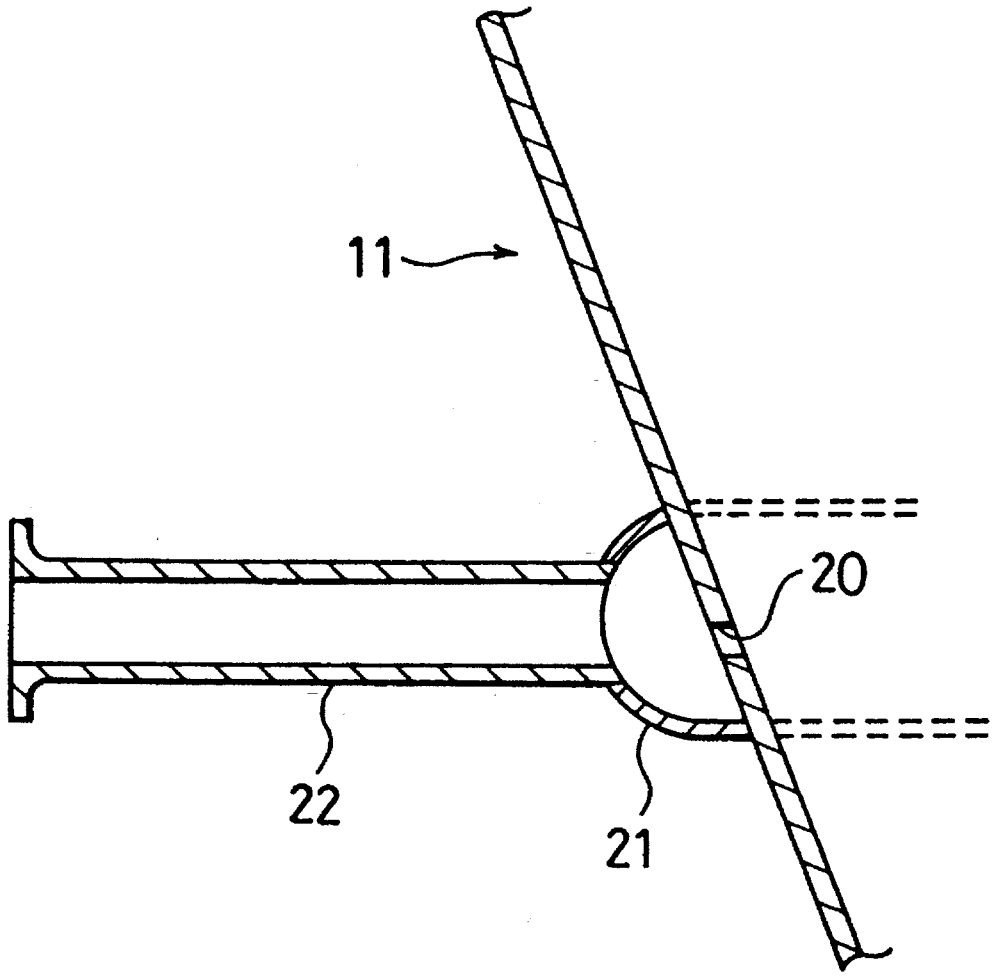
FIG. 9 is an enlarged section view showing the arrangement around a nozzle disposed in a cone portion of a comparative example described later.

In this embodiment, as most clearly shown in FIG. 5, the gas inlet of each nozzle 20 is positioned at the lowermost end of the ring-like shell 21, and an arrangement is made such that the nozzles 20 are disposed, in communicating relationship, at respective lower zones of the interstices present between the ring-like shell 21 and the external surface of the circular wall of the cone portion. This is because when the nozzles 20 are disposed in positions corresponding to nearly the middle of the ring-like shell 21 as shown in FIG. 9, there is the danger that powder enters through the nozzles 20 into the ring-like shell 21 so that it cannot be removed. That is, by the above-mentioned arrangement, even if powder temporarily enters from the interstices into the ring-like shell 21, the powder can easily be removed from the interstices under the ring-like shell 21 by means of heated nitrogen gas (high temperature gas).

A plurality of gas feed pipes 22 (two pipes per ring-like shell as shown in FIG. 1) for feeding heated nitrogen gas as a high temperature gas are respectively connected to a plurality of ring-like shells 21. The gas feed pipes 22 are connected to a supply source (not shown) of heated nitrogen gas (90° C. to 110 ° C.). Further, each gas feed pipe 22 is provided with a flow control valve (not shown). This flow control valve is adapted to regulate the flow rate of heated nitrogen gas so as to render uniform the pressure of the heated nitrogen gas injected through each nozzle 20.

The lower the position of the row of nozzles 20, the smaller the number of nozzles 20. Also, the lower the position of the ring-like shell 21, the smaller the diameter of the ring. Accordingly, to render uniform the pressure at each nozzle 20, it is preferable that a greater amount of heated nitrogen gas be supplied to a gas feed pipe 22 disposed at a position corresponding to an upper row, while the lower the position of the gas feed pipe 22, the amount of supplied heated nitrogen gas is rendered the smaller.

In the structure of this embodiment, not only the nozzles 20 are uniformly arranged substantially throughout the circular wall of the cone portion 11, but also the heated nitrogen gas from the gas feed pipe 22 is fed into the interstice under the ring-like shells 21, and then injected through the nozzles 20 into the inside of the cone portion 11. Therefore, the pressure of injected heated nitrogen gas can be rendered uniform so that the heated nitrogen gas is uniformly brought into contact with the powder descending in the drying hopper 1 to thereby markedly improve fluidization efficiency.

Figure 6:
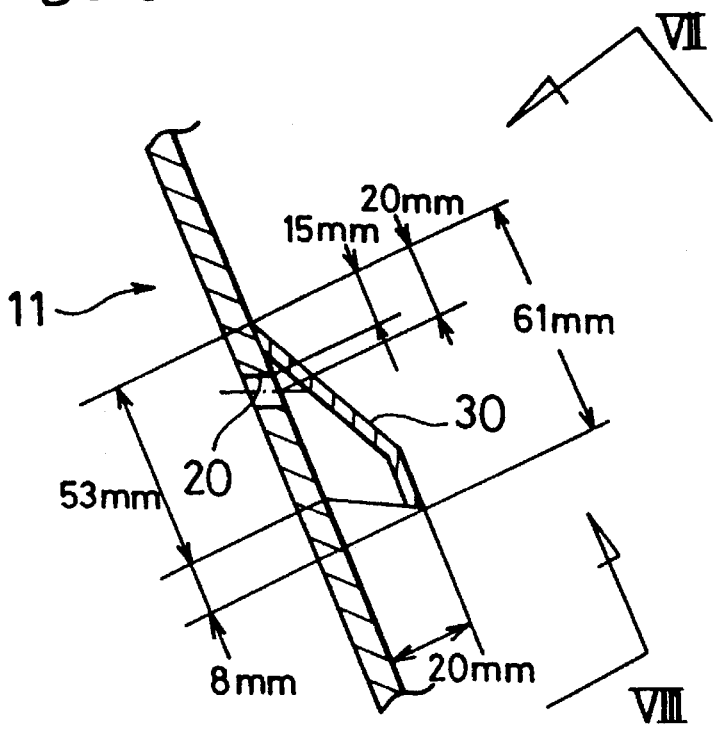
FIG. 6 is an explanatory view for a covering member, which is an enlarged section view showing the arrangement around a nozzle disposed in a cone portion.
Figure 7:
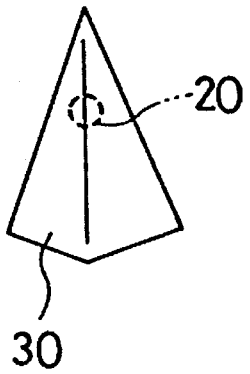
FIG. 7 is a view of a covering member observed in the direction indicated by arrow VII of FIG. 6.
Figure 8:
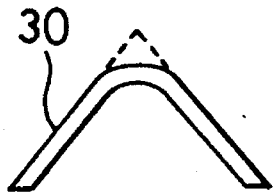
FIG. 8 is a view of a covering member observed in the direction indicated by arrow VIII of FIG. 6.

As most clearly shown in FIGS. 5 through 8, a plurality of covering members 30 are attached to an internal surface of the circular wall of the cone portion 11, which covering members respectively cover the nozzles 20 at gas outlets thereof with an interstice between the covering member 30 and the internal surface of the circular wall. This covering member 30 may be obtained for example, by bend-pressing a metal plate, which is in the form of a tetragon consisting of two bisymmetrical triangles, at the symmetry axis (cornered at a radius R) as shown in FIGS. 7 and 8. The interstice present between the covering member 30 and the internal surface of the circular wall of the cone portion 11 has a cross section gradually expanding toward the lower end thereof. Dimensions of the covering member 30 appropriate when the diameter of the nozzle 20 is 10 mm are shown in FIG. 6 (unit: mm). As shown in FIG. 6, the gas outlets of the nozzles 20 are positioned in the respective interstices between the covering members 30 and the internal surfaces of the circular wall of the cone portion 11, above respective lower ends of the covering members 30. The covering members 30 are left open at lower ends thereof.

Since the covering member 30 has a structure as described above, the heated nitrogen gas to be injected from the nozzles 20 into the drying hopper 1 is guided by the covering member 30 and injected downward. As indicated above, the volume of the interstice between the covering member 30 and the internal surface of the circular wall of the cone portion 11 is small around the gas outlets of the nozzles 20 and large around the lower end of the covering member 30, so that the flow rate of the heated nitrogen gas is high around the upper end of the covering member 30 and that the lower the position of the heated nitrogen gas, the smaller the flow rate thereof. By virtue of this structure, the entry of powder into the nozzles 20 is prevented with certainty, and the heated nitrogen gas is injected substantially uniformly over a wide area of the cone portion 11. Moreover, the powder descending in the drying hopper 1 moves along an external slant surface of the covering member 30, so that there is substantially no accumulation of the powder on the top of the covering member 30.

In particular, since the pressure of the heated nitrogen gas injected through the nozzles 20 into the interstice between the covering member 30 and the external surface of the circular wall of the cone portion 11 is higher than the pressure outside the covering member there would be substantially no entry of the powder from the lower end of the covering member 30 into the interstice under the covering member 30. Therefore, the covering member is extremely effective for preventing the entry of the powder into the nozzles 20.

Hereinbelow, one mode of the powder drying method for drying a polyolefin powder obtained by a solid liquid separation of a polyolefin slurry produced by a slurry polymerization by the use of the drying hopper 1 having the above structure will be illustrated with reference to FIG. 10.

The polyolefin powder obtained in the above-mentioned solid liquid separation is generally in the form of a wet cake, which is not critical in the present invention. Representative examples of polyolefins include an ethylene homopolymer, a linear low density polyethylene (LLDPE) and polypropylene.

Figure 10:
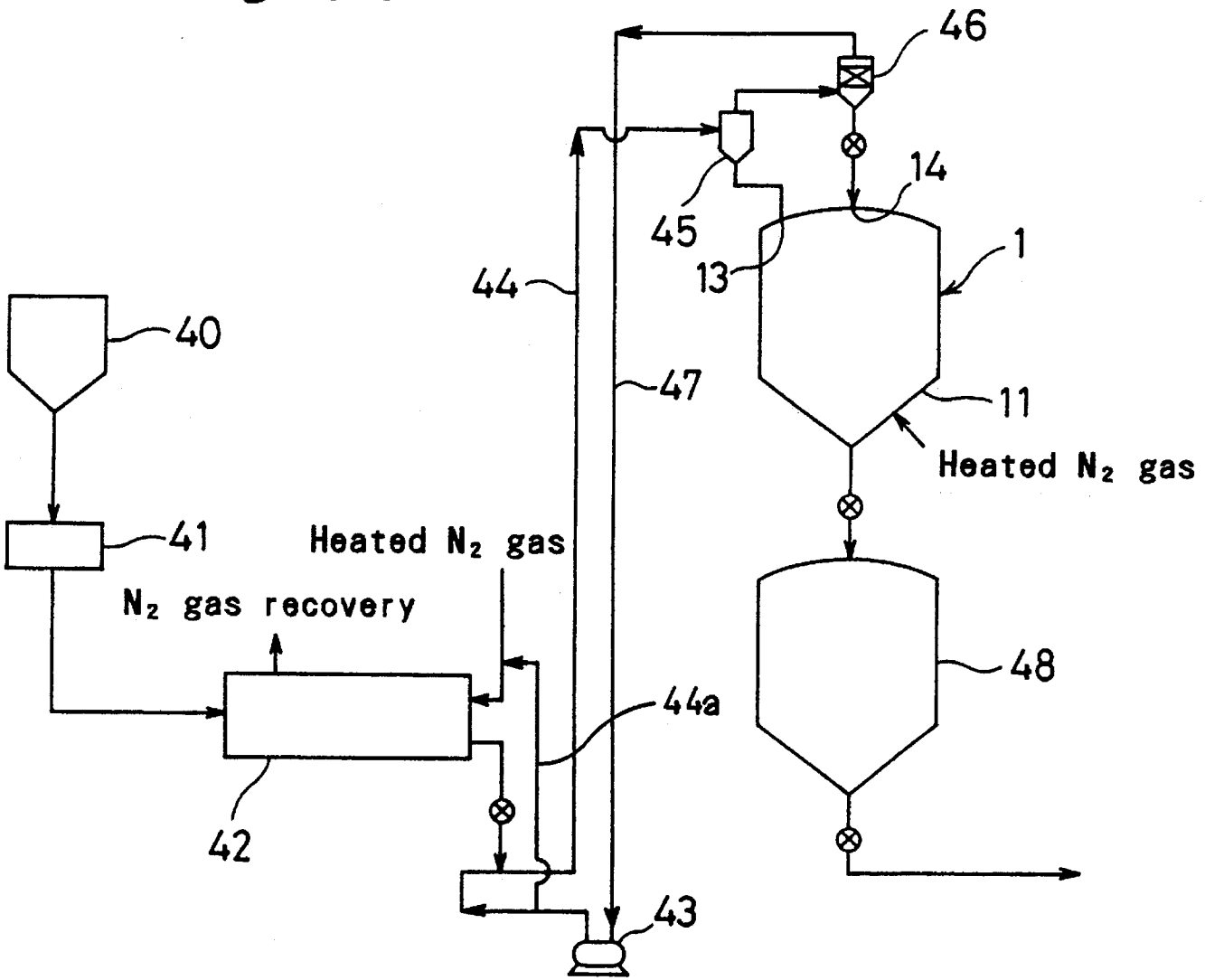
FIG. 10 is an explanatory view for a drying method of polyolefins.

In FIG. 10, numeral 40 indicates a polymerization reactor for polymerizing an olefin using an olefin polymerization catalyst comprising an alkylaluminum compound and titanium tetrachloride and a solvent, such as hexane. The polyolefin slurry obtained by this polymerization is passed through a filter 41 to effect a solid liquid separation, thereby obtaining a polyolefin powder.

The above-mentioned solvent for use in the slurry polymerization is not limited to hexane, and includes other various solvents, such as decane.

The thus obtained polyolefin powder is charged into a rotary dryer 42, in which the polyolefin powder is dried to a solvent content of, for example, from 1,000 to 10,000 ppm by weight, preferably from 2,000 to 3,000 ppm by weight.

As the rotary dryer 42, the conventional rotary dryers can be used without any limitation. In the rotary dryer 42, a hot air is used, which is for example, nitrogen gas heated at 90° to 110 ° C., preferably 100° to 105° C.

The polyolefin powder dried in the rotary dryer 42 is further dried by means of the drying hopper 1. Hereinbelow, the drying by means of the drying hopper 1 will be illustrated.

A blower 43 is arranged between the rotary dryer 42 and the drying hopper 1. The blower 43 is connected to a discharge pipe 44, which is connected to the above-mentioned rotary dryer 42 at a midway thereof and to a cyclone 45 at the end thereof. The cyclone 45 has a discharge opening connected to a powder inlet 13 of the drying hopper 1, so that the polyolefin powder dried in the rotary dryer 42 is introduced into the inside of the drying hopper 1 from an upper portion thereof.

The above-mentioned cyclone further has a gas outlet connected to a filter 46, which is connected to the blower 43 through a suction pipe 47. The discharge pipe 44 connected to the blower 43 is branched before the connecting point with the rotary dryer 42 so as for the discharge pipe to be connected not only the rotary dryer 42 but also to a heated nitrogen gas feed pipe connected to the rotary dryer 42.

Thus, the heated nitrogen gas used in the drying hopper 1 is introduced through the cyclone 45 and then through the filter 46 and line 47 into the blower 43. The heated nitrogen gas is introduced through the discharge pipe **44*a* into the rotary dryer 42** for recovery therefrom.

Moreover, the filter 46 is connected to another powder inlet 14 of the drying hopper 1, so that the polyolefin powder collected by the filter 46 is introduced into the drying hopper 1.

As mentioned above, the solvent content of the polyolefin powder can be effectively reduced by feeding the polyolefin powder into the drying hopper 1 from an upper end thereof, while uniformly injecting nitrogen gas heated at for example, 90°–110° C. through a plurality of nozzles 20 into the drying hopper 1 so as to bring the high temperature gas into counterflow contact with the powder descending in the drying hopper 1.

In the drying hopper 1, the polyolefin powder is dried to a solvent content of 50 ppm by weight or less, preferably 20 ppm by weight or less, and more preferably 10 ppm by weight or less.

In the drying hopper 1, the polyolefin powder is retained for a period of from about 30 to about 60 minutes, preferably from about 30 to about 40 minutes. The amount of heated nitrogen gas used (heated nitrogen gas/polyolefin powder) is generally in the range of from 20 to 100 $Nm^3$/ton-polyolefin, preferably from 40 to 60 $Nm^3$/ton-polyolefin. When the polyolefin powder is retained in the drying hopper 1 for a period of from about 30 to about 45 minutes, it is preferred that the average flow rate (linear velocity of gas) of heated nitrogen gas be in the range of from 0.5 to 2.5 cm/sec.

The above-mentioned heated nitrogen gas generally has a temperature of from 90° to 110° C., preferably from 100° to 105° C. The heating of the nitrogen gas is preferably carried out by a low pressure steam. In the heating of the nitrogen gas by a low pressure steam, for example, the temperature of the nitrogen gas is elevated to 90°–110° C. by a steam having a pressure as low as from 3 to 10 $kg/cm^2G$ in a heat exchanger.

The heated nitrogen gas, as mentioned above, is introduced through a plurality of nozzles 20 into the drying hopper 1, and is brought into counterflow contact with the polyolefin powder descending in the drying hopper 1 from an upper end to a lower end. At that time, the pressure in the drying hopper 1 is generally in the range of from 0.02 to 0.5 $kg/cm^2G$, preferably from 0.03 to 0.5 $kg/cm^2G$.

The heated nitrogen gas used in the drying of the polyolefin powder is recycled into the rotary dryer 42 for use therein, and recovered therefrom.

The heated nitrogen gas used in the drying of the polyolefin powder in the drying hopper 1 and the rotary dryer 42 contains solvents. These solvents may be recovered by cooling the nitrogen gas, or alternatively may be incinerated without recovery.

The dried polyolefin powder obtained by the above procedure is temporarily stocked in a stock hopper 48. When the polyolefin is pelletized, the polyolefin powder stocked in the stock hopper 48 is subjected to a pelletizer to obtain pellets.

By virtue of the above drying method, the solvent content of the polyolefin powder is drastically reduced with low operating costs and simple operations.

The present invention is not limited to the above embodiment, and various modifications can be made.

In particular, the drying hopper of the present invention is most suitable for use in the drying of polyolefins, but is not limited thereto. The drying hopper can also be advantageously utilized in the drying of food powder, such as flour, cement, active sludge and other various powders. In the above embodiment, the powder is represented by polyolefin powder, but not limited thereto. The terminology "powder" used herein includes granules. The shape and structure of the drying hopper according to the present invention is not limited to those shown in the drawings, and design changes can be effected thereto.

The conditions and results of the drying of the polyethylene powder by the use of the system shown in FIG. 10 described above, are set out in the following Examples.

In the following Examples, the hexane content and the volatile matter content for the polyethylene powder were determined by the following methods.

(1) hexane content

A polyethylene powder specimen was immersed in xylene kept at 70° C. for 2 hours, and the amount of hexane dissolved in the xylene was measured by gas chromatography. The terminology "hexane content" used herein means that amount.

(2) volatile matter content

A polyethylene powder specimen was heated in an oven set at 105+2° C. for one hour, and the weight decrease by the heating was measured. The terminology "volatile matter content" used herein means that weight decrease.

The volatile matter includes, besides hexane, impurities which are contained in the hexane and compounds having 7 to 12 carbon atoms, and a co-catalyst (alkylaluminum compound).

EXAMPLE 1

The rotary dryer dried polyethylene powder to a hexane content of about 2,000 ppm by weight. The polyethylene powder was further dried while being transferred to the drying hopper by the heated nitrogen gas to exhibit a hexane content of 500 ppm by weight and a volatile matter content of 2,000 ppm by weight at a powder inlet of the drying hopper. 10 kg of the resultant polyethylene powder was introduced into the drying hopper (206 mm in inside diameter and 1,000 mm in length) from an upper end thereof, while injecting nitrogen gas heated at 105° C. into the drying hopper through the nozzles of the cone portion thereof. The heated nitrogen gas was brought into counterflow contact with the polyethylene powder descending in the drying hopper from an upper end to a lower end thereof, under conditions such that the retention time (drying time) of the polyethylene powder in the drying hopper was 30 minutes, that the amount ratio of the heated nitrogen gas to the polyethylene powder (heated nitrogen gas/polyethylene powder) was 20 $Nm^3$/ton-polyethylene, that the flow rate of the heated nitrogen gas was 6.7 Nl/min., and that the linear velocity of the nitrogen gas was 0.47 cm/sec.

The resultant polyethylene powder discharged from the drying hopper exhibited a hexane content of 20 ppm by weight and a volatile matter content of 600 ppm by weight.

EXAMPLE 2

The polyethylene powder was dried in substantially the same manner as in Example 1, except that the drying time of the polyethylene powder in the drying hopper was changed to 40 minutes.

The resultant polyethylene powder discharged from the drying hopper exhibited a hexane content of 10 ppm by weight and a volatile matter content of 400 ppm by weight.

EXAMPLE 3

The polyethylene powder was dried in substantially the same manner as in Example 1, except that the drying time of the polyethylene powder in the drying hopper was changed to 20 minutes.

The resultant polyethylene powder discharged from the drying hopper exhibited a hexane content of 50 ppm by weight and a volatile matter content of 700 ppm by weight.

EXAMPLE 4

The polyethylene powder was dried in substantially the same manner as in Example 1, except that the amount ratio of the heated nitrogen gas to the polyethylene powder (heated nitrogen gas/polyethylene powder) was 40 $Nm^3$/ton-polyethylene, that the flow rate of the heated nitrogen gas was 13.4 Nl/min., and that the linear velocity of the nitrogen gas was 0.94 cm/sec.

The resultant polyethylene powder discharged from the drying hopper exhibited a hexane content of 10 ppm by weight and a volatile matter content of 300 ppm by weight.

EXAMPLE 5

The polyethylene powder was dried in substantially the same manner as in Example 4, except that the drying time of the polyethylene powder in the drying hopper was changed to 40 minutes.

The resultant polyethylene powder discharged from the drying hopper exhibited a hexane content of 5 ppm by weight and a volatile matter content of 240 ppm by weight.

EXAMPLE 6

The polyethylene powder was dried in substantially the same manner as in Example 4, except that the drying time of the polyethylene powder in the drying hopper was changed to 20 minutes.

The resultant polyethylene powder discharged from the drying hopper exhibited a hexane content of 30 ppm by weight and a volatile matter content of 450 ppm by weight.

EXAMPLE 7

The polyethylene powder was dried in substantially the same manner as in Example 4, except that the drying time of the polyethylene powder in the drying hopper was changed to 10 minutes.

The resultant polyethylene powder discharged from the drying hopper exhibited a hexane content of 100 ppm by weight and a volatile matter content of 700 ppm by weight.

EXAMPLE 8

The polyethylene powder was dried in substantially the same manner as in Example 1, except that the amount ratio of the heated nitrogen gas to the polyethylene powder (heated nitrogen gas/polyethylene powder) was 60 $Nm^3$/ton-polyethylene, that the flow rate of the heated nitrogen gas was 20 Nl/min., and that the linear velocity of the nitrogen gas was 1.40 cm/sec.

The resultant polyethylene powder discharged from the drying hopper exhibited a hexane content of 5 ppm by weight and volatile matter content of 200 ppm by weight.

EXAMPLE 9

The polyethylene powder was dried in substantially the same manner as in Example 8, except that the drying time of the polyethylene powder in the drying hopper was changed to 40 minutes.

The resultant polyethylene powder discharged from the drying hopper exhibited a hexane content of 5 ppm by weight and a volatile matter content of 150 ppm by weight.

EXAMPLE 10

The polyethylene powder was dried in substantially the same manner as in Example 8, except that the drying time of the polyethylene powder in the drying hopper was changed to 20 minutes.

The resultant polyethylene powder discharged from the drying hopper exhibited a hexane content of 25 ppm by weight and a volatile matter content of 300 ppm by weight.

EXAMPLE 11

The polyethylene powder was dried in substantially the same manner as in Example 8, except that the drying time of the polyethylene powder in the drying hopper was changed to 10 minutes.

The resultant polyethylene powder discharged from the drying hopper exhibited a hexane content of 65 ppm by weight and a volatile matter content of 500 ppm by weight.

EXAMPLE 12

10 kg of a polyethylene powder dried in the rotary dryer to have a hexane content of 1,000 ppm by weight and a volatile matter content of 2,000 ppm by weight was introduced into the drying hopper as used in Example 1 from an upper end thereof, while injecting nitrogen gas heated at 105° C. into the drying hopper through the nozzles of the cone portion thereof. The heated nitrogen gas was brought into counterflow contact with the polyethylene powder descending in the drying hopper from an upper end to a lower end thereof, under conditions such that the retention time (drying time) of the polyethylene powder in the drying hopper was 30 minutes, that the amount ratio of the heated nitrogen gas to the polyethylene powder (heated nitrogen gas/polyethylene powder) was 40 $Nm^3$/ton-polyethylene, that the flow rate of the heated nitrogen gas was 13.4 Nl/min., and that the linear velocity of the nitrogen gas was 0.94 cm/sec.

The resultant polyethylene powder discharged from the drying hopper exhibited a hexane content of 18 ppm by weight and a volatile matter content of 275 ppm by weight.

EXAMPLE 13

The polyethylene powder was dried in substantially the same manner as in Example 12, except that the drying time of the polyethylene powder in the drying hopper was changed to 40 minutes.

The resultant polyethylene powder discharged from the drying hopper exhibited a hexane content of 10 ppm by weight and a volatile matter content of 195 ppm by weight.

EXAMPLE 14

The polyethylene powder was dried in substantially the same manner as in Example 12, except that the drying time of the polyethylene powder in the drying hopper was changed to 20 minutes.

The resultant polyethylene powder discharged from the drying hopper exhibited a hexane content of 47 ppm by weight and a volatile matter content of 400 ppm by weight.

EXAMPLE 15

The polyethylene powder was dried in substantially the same manner as in Example 12, except that the drying time of the polyethylene powder in the drying hopper was changed to 10 minutes.

The resultant polyethylene powder discharged from the drying hopper exhibited a hexane content of 130 ppm by weight and a volatile matter content of 700 ppm by weight.

EXAMPLE 16

The polyethylene powder was dried in substantially the same manner as in Example 12, except that the amount ratio of the heated nitrogen gas to the polyethylene powder (heated nitrogen gas/polyethylene powder) was 60 $Nm^3$/ton-polyethylene, that the flow rate of the heated nitrogen gas was 20 Nl/min., and that the linear velocity of the nitrogen gas was 1.40 cm/sec.

The resultant polyethylene powder discharged from the drying hopper exhibited a hexane content of 9 ppm by weight and a volatile matter content of 125 ppm by weight.

EXAMPLE 17

The polyethylene powder was dried in substantially the same manner as in Example 16, except that the drying time of the polyethylene powder in the drying hopper was changed to 40 minutes.

The resultant polyethylene powder discharged from the drying hopper exhibited a hexane content of 5 ppm by weight and a volatile matter content of 90 ppm by weight.

EXAMPLE 18

The polyethylene powder was dried in substantially the same manner as in Example 16, except that the drying time of the polyethylene powder in the drying hopper was changed to 20 minutes.

The resultant polyethylene powder discharged from the drying hopper exhibited a hexane content of 19 ppm by weight and a volatile matter content of 155 ppm by weight.

EXAMPLE 19

The polyethylene powder was dried in substantially the same manner as in Example 16, except that the drying time of the polyethylene powder in the drying hopper was changed to 10 minutes.

The resultant polyethylene powder discharged from the drying hopper exhibited a hexane content of 58 ppm by weight and a volatile matter content of 300 ppm by weight.

As specified above, in the drying hopper according to the present invention, the high temperature gas from the gas feed pipe is fed into the interstice under the ring-like shell, and then injected through the nozzles into the inside of the cone portion of the drying hopper. Accordingly, the pressure of the injected high temperature gas is rendered substantially uniform. Further, since the nozzles are uniformly arranged substantially throughout the circular wall of the cone portion, the high temperature gas is uniformly brought into contact with the powder fed from an upper portion of the drying hopper and descending therein to thereby markedly improve fluidization efficiency. Moreover, by virtue of the covering member provided on the internal surface of the circular wall of the cone portion to cover the gas outlets of the nozzles, the entry of the powder descending in the cone portion into the nozzles can be effectively prevented.

Still further, by virtue of the covering member provided on the internal surface of the slant, circular wall of the cone portion to cover the gas outlets of the nozzles with an interstice between the covering member and the internal surface of the circular wall with an interstice left open at a lower end thereof, the gas injected through the nozzles is dispersed downward from the inside of the covering member to contact the powder while the powder descending along the slant, circular wall is always outside the covering member and does not enter at all into the covering member. Thus, the counterflow of the powder into the nozzles is effectively prevented, so that a decrease in powder drying capacity is prevented and maintenance is facilitated.

According to the powder drying method of the present invention, the powder, such as the polyolefin powder obtained by a solid liquid separation of a polyolefin slurry produced by a slurry polymerization, is effectively dried to an extremely reduced solvent content with reduced operating costs and simple operations.

What is claimed is:

1. A method for drying powder, comprising: providing a drying hopper comprising an upper cylindrical portion and a lower conical portion, said lower conical portion having a slanted, circular wall having a diameter which decreases toward a lower end of said lower conical portion, said lower conical portion having a plurality of nozzles formed through said slanted, circular wall, said plurality of nozzles being uniformly disposed throughout said conical portion;

introducing powder to be dried into said drying hopper through powder inlets disposed in said upper cylindrical portion and allowing said powder to descend through said drying hopper injecting a high temperature gas into said drying hopper, through said plurality of nozzles formed through said slanted, circular wall, so as to bring the high temperature gas into counterflow contact with said powder descending in the drying hopper;

removing dried powder from said lower end of said lower conical portion of said drying hopper;

removing said gas through an outlet disposed in said upper cylindrical portion of said drying hopper.

2. The method according to claim 1, wherein said powder is a polyolefin powder obtained by a solid liquid separation of a polyolefin slurry produced by a slurry polymerization.

3. The method according to claim 2, wherein said polyolefin is selected from an ethylene homopolymer, a linear low density polyethylene and polypropylene.

4. The method according to 2, wherein the high temperature gas injected into the drying hopper is a nitrogen gas heated at 90° to 110° C.

5. The method according to claim 2, wherein said polyolefin powder is retained in the drying hopper for a period of from 30 to 60 minutes.

6. The method according to claim 4, wherein the heated nitrogen gas is injected into the drying hopper at a rate of from 20 to 60 $Nm^3$/ton-polyolefin.

7. The method according to claim 2, wherein said polyolefin powder is dried in the drying hopper to a solvent content of 20 ppm by weight or less.

8. The method according to claim 1, wherein said plurality of nozzles amount to at least one nozzle for each cubic meter of hopper volume.

9. The method according to claim 1, wherein said plurality of nozzles are disposed as a plurality of vertically spaced rows of nozzles, each nozzle in a row disposed at a predetermined interval in a circumferential direction of said slanted, circular wall.

* * * * *